US006482070B2

(12) United States Patent
Hogan

(10) Patent No.: US 6,482,070 B2
(45) Date of Patent: Nov. 19, 2002

(54) GRAVITY-POWERED TOY VEHICLE WITH DYNAMIC MOTION REALISM

(76) Inventor: Philip A. Hogan, 1902 Pine Tree Trail, Ely, MN (US) 55731

( * ) Notice: Subject to any disclaimer, the term of this patent is extended or adjusted under 35 U.S.C. 154(b) by 0 days.

(21) Appl. No.: 09/790,448

(22) Filed: Feb. 21, 2001

(65) Prior Publication Data

US 2001/0007806 A1 Jul. 12, 2001

Related U.S. Application Data

(63) Continuation-in-part of application No. 09/477,304, filed on Jan. 4, 2000.

(51) Int. Cl.[7] ..... A63H 29/22
(52) U.S. Cl. ..... 446/462; 446/444
(58) Field of Search ..... 446/462, 444, 446/445, 467

(56) References Cited

U.S. PATENT DOCUMENTS 3,810,515 A * 5/1974 Ingro ..... 180/164
4,031,661 A * 6/1977 Bernhard ..... 446/130
4,386,777 A * 6/1983 Prehodka ..... 104/281
4,443,967 A * 4/1984 Jones et al. ..... 446/462
5,118,320 A * 6/1992 Miller ..... 104/245
5,823,848 A * 10/1998 Cummings ..... 446/429

* cited by examiner

*Primary Examiner*—Derris H. Banks
*Assistant Examiner*—Faye Francis

(57) ABSTRACT

A gravity-powered toy vehicle, such as a model roller coaster, with an energy-storing flywheel coupled to the wheels to reduce the vehicle velocity so it approaches that which is proportionately realistic for the model scale. The initial potential energy of the vehicle is mostly conserved over the course of the track just as with a real roller coaster. At all points on the track the velocity of the model vehicle is reduced by a constant proportion compared to an unrestrained free-fall vehicle. Thus the dynamic velocity profile of the toy vehicle is the same as for a full size vehicle throughout its descending and ascending journey, but at a proportionately reduced speed.

5 Claims, 5 Drawing Sheets

GRAVITY-POWERED TOY VEHICLE WITH DYNAMIC MOTION REALISM

CROSS-REFERENCE TO RELATED APPLICATIONS

This application is a continuation in part of U.S. patent application Ser. No. 09/477,304 that was filed with the United States Patent and Trademark Office on Jan. 4, 2000. The entire disclosure of U.S. patent application Ser. No. 09/477,304 is incorporated herein by reference

STATEMENT REGARDING FEDERALLY SPONSORED RESEARCH OR DEVELOPMENT

Not applicable

REFERENCE TO A MICROFICHE APPENDIX

Not Applicable

BACKGROUND OF THE INVENTION

This invention relates to gravity-powered toy vehicles, such as a model roller coaster, operating on an inclined plane. It also relates to the use of an energy-storing flywheel, and permanent magnets for improved traction.

Model roller coaster toys have been built for many years by both hobbyists and toy manufacturers, but have not caught on with the general public in the same manner as model trains, cars or airplanes. This lack of interest is in spite of the current great popularity of amusement parks and the ever increasing number of roller coasters as park centerpieces. Most existing model roller coasters operate in the same manner as full-size roller coasters. They are powered only by the force of gravity over a series of hills—following the physical laws of motion for free-fall of an essentially frictionless body on an inclined plane track. The problem with these models is that although they may be physically realistic the dynamic motion of the vehicle is quite unrealistic because the apparent speed is far too fast.

To be realistic the velocity of a model should be reduced in proportion to the scale of the model. However, because existing models and full-size roller coasters both follow the same physical laws of free-fall motion the velocity of existing models at any given distance down the track is the same as for a full-size roller coaster. This means, for example, that the time for a real roller coaster to roll just four feet down a 200 foot high track is about the same as a model roller coaster takes to reach the bottom of a four foot high model track—quite unrealistic. It can be shown that the apparent velocity of a model, allowed to roll in unrestrained free-fall, is multiplied by the square root of the model's dimensional scale factor. For example, a model scaled to 1/50 size, will reach a maximum apparent velocity on the first hill of 495 miles per hour rather than the 70 miles per hour maximum velocity typically reached by real roller coasters. This effect is independent of model configuration, and due only to the physical laws of free-fall motion.

Another problem with existing model roller coasters is that because they run so fast they tend to fly off the track (as could be expected of a real roller coaster running at speeds of up to 495 miles per hour).

The present invention uses the energy-storing property of a flywheel to eliminate this problem by reducing the velocity of the toy vehicle. It also uses the attraction force of permanent magnets to extend the practical implementation of the invention to operate on steep slopes in a low energy loss environment whereby the stored flywheel energy is released to propel the vehicle back up ascending track slopes just as with real roller coasters.

The use of flywheels in toy vehicles is not new. There are a number of examples in the prior art. However, the use of a flywheel to convert a portion of the potential energy of a gravity-powered toy vehicle into rotational kinetic energy rather than translational kinetic energy is unique. Likewise, the use of magnetic attraction in toy vehicles is not new, but it is the combination of this feature with the flywheel feature and the feature of low frictional energy loss that provides the unique and unexpected results provided by the subject invention. The flywheel feature alone combined with low frictional energy loss provides the unexpected result of the subject invention on relatively low inclined plane slopes. However, combining the flywheel feature with the magnetic attraction feature provides the unexpected results with the aggressive steep slopes characteristic of real roller coasters. The magnetic attraction feature provides the necessary traction with minimum loss of energy to achieve the results of the subject invention. Without combining these features the vehicle would be a much less realistic and exciting toy.

U.S. Pat. No. 5,118,320 describes a model roller coaster that is characteristic of existing gravity-powered toy vehicles operating in free-fall motion on a track of complex configuration. Because the model motion is unrestrained the velocity of the vehicle, unlike with the subject invention, is quite unrealistic for the model's scale.

U.S. Pat. No. 4,443,967 describes a flywheel driven toy car. The flywheel is powered by manually pushing on the car before releasing it. It is not designed to be used as a gravity-powered vehicle, such as a model roller coaster, both because it has high frictional energy loss, and because it would tend to slide rather than roll down relatively mild track slopes.

U.S. Pat. No. 4,031,661 describes the use of permanent magnets in a motor-powered toy racing car to improve traction for acceleration and to prevent skidding on curves. U.S. Pat. No. 3,810,515 describes use of magnetic wheels on a wall climbing device to cause it to adhere to vertical walls of ferrous material. However, neither invention can be used to perform the function of the subject invention, because neither uses a true flywheel, and because both operate with high frictional energy loss which would preclude operation on an ascending track using energy stored within the vehicle.

The subject invention provides a practical solution to the problem of dynamic motion realism in a gravity-powered toy vehicle operating on descending and ascending track slopes. Without this solution gravity-powered toy vehicles, no matter how realistic in physical appearance, lack the essential element of motion realism. The unobviousness of the subject invention is apparent from the fact that the problem has existed for decades without solution in the crowded field of miniature toy vehicles.

BRIEF SUMMARY OF THE INVENTION

The preferred embodiment of the present invention uses an energy-storing flywheel, coupled to the wheels of a gravity-powered toy vehicle, such as a roller coaster, to reduce its velocity so it approaches that which is proportionately realistic for the model scale. The term gravity-powered means the toy vehicle is powered substantially by the force of gravity alone with no other source of power either internal or external to the toy vehicle after it is first raised to a point of elevation The initial potential energy of the vehicle is mostly conserved over the course of the track comprised of both descending and ascending track slopes just as with a real roller coaster. At all points on the track the velocity of the model vehicle is reduced by a constant factor compared to an unrestrained free-fail model vehicle. Thus the dynamic velocity profile of the toy vehicle is the same as for an unrestrained gravity-powered vehicle throughout its descending and ascending journey, but at a proportionately reduced velocity.

In one embodiment of the present invention the flywheel is mounted on the same axle as the vehicle wheels. In that configuration the flywheel diameter must be larger than the wheel diameter in order to achieve sufficient rotational kinetic energy, and must therefore extend below the plane of the vehicle wheels. This requires a track support mechanism that provides clearance for the flywheel.

With real roller coasters and previous embodiments of roller coaster models there is minimal need for traction between the vehicle wheels and track since the vehicle is in a normal free-fall condition. However, with the preferred embodiments of the present invention, traction between the vehicle wheel and the track is needed to supply the force needed to turn the flywheel without the wheel slipping. These embodiments provide for the use of magnetic attraction between the vehicle and track using permanent magnets in either the wheel or vehicle chassis, and a ferromagnetic material in the track. The force of attraction increases the instantaneous static friction between the rolling wheel and track at their point of contact in order to provide increased traction, but since there is no sliding friction there is minimal energy loss.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown embodiments which are presently preferred. It should be understood, however, that the invention is not limited to the precise arrangements and instrumentalities shown. In the drawings.

DETAILED DESCRIPTION OF THE INVENTION

Figure 1:
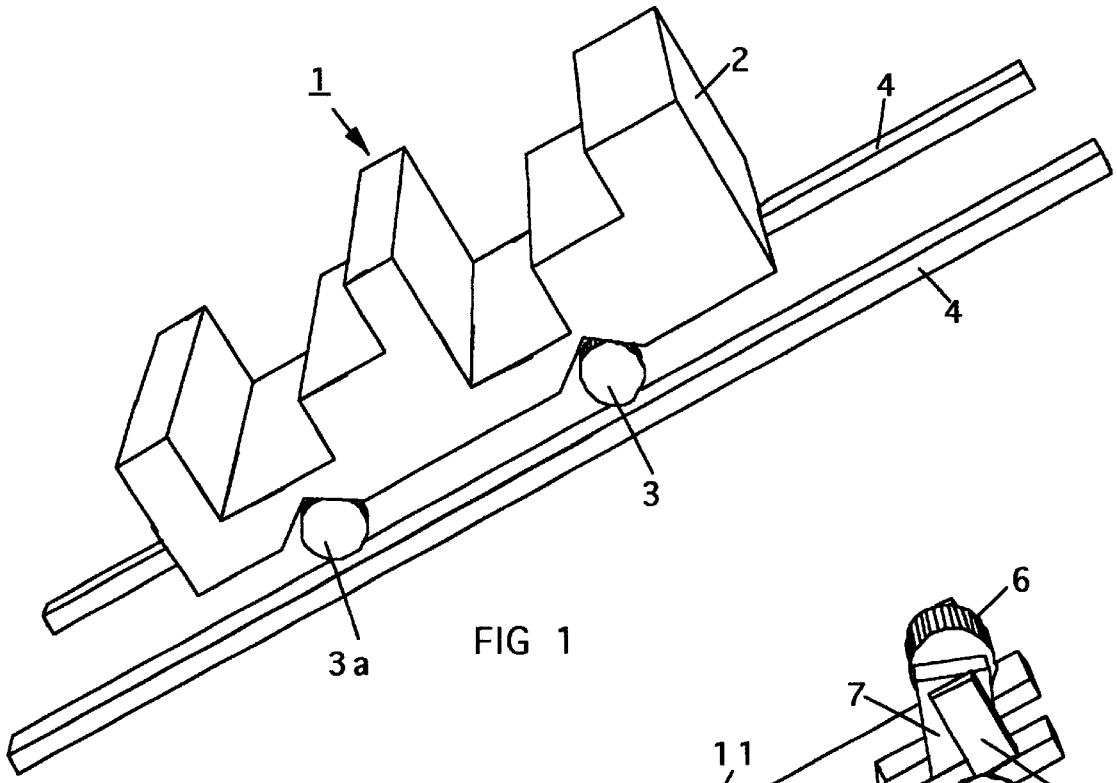
FIG. 1 is a perspective view of a toy roller coaster vehicle according to the first embodiment of the present invention where the flywheel is on a shaft separate from the wheel axle.
Figure 2:
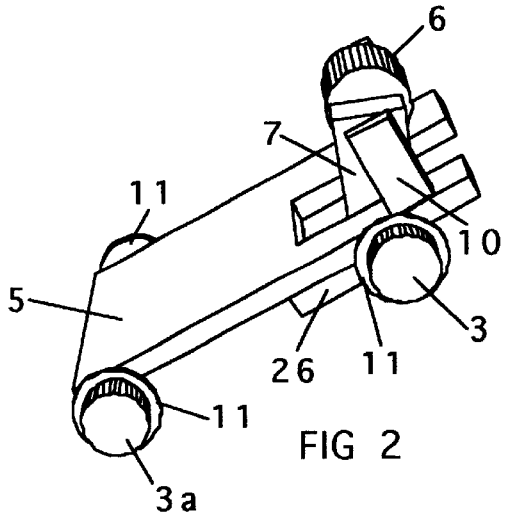
FIG. 2 is a perspective view of the chassis, wheels, flywheel, and gear train of the vehicle in FIG. 1 with the outer body removed.
Figure 3:
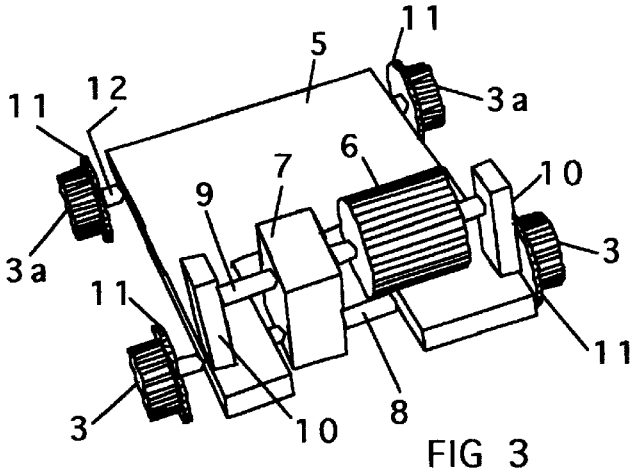
FIG. 3 is another perspective view of the vehicle in FIG. 2, but rotated to better view the arrangement of the rotational coupling between the wheels and flywheel.

In the drawings, like numerals are used to indicate like elements throughout. There is shown in FIGS. 1–3 a first embodiment toy roller coaster having a flywheel 6 rotating with a higher angular velocity than a pair of driving wheels 3. FIG. 1 shows a toy vehicle 1 with a light weight body-shaped cover 2 in place, and resting on a section of track rails 4.

FIG. 2 and 3 show vehicle 1 with the cover 2 and rails 4 removed. Drive wheels 3 are mounted on an axle 8 and connected to a chassis 5 using conventional low-friction bearings (not shown). Free rotating wheels 3*a* are mounted on an axle 12 and also connected to chassis 5 using conventional low-friction bearings (not shown). Flywheel 6 is mounted on a shaft 9 which is connected to chassis 5 through support brackets 10 using conventional low-friction bearings (not shown). Flywheel 6 is coupled to driving wheels 3 through a gear train 7 which couples flywheel shaft 9 to wheel axle 8 in such a way that the angular velocity of flywheel 6 is greater than the angular velocity of driving wheels 3.

Figure 8:
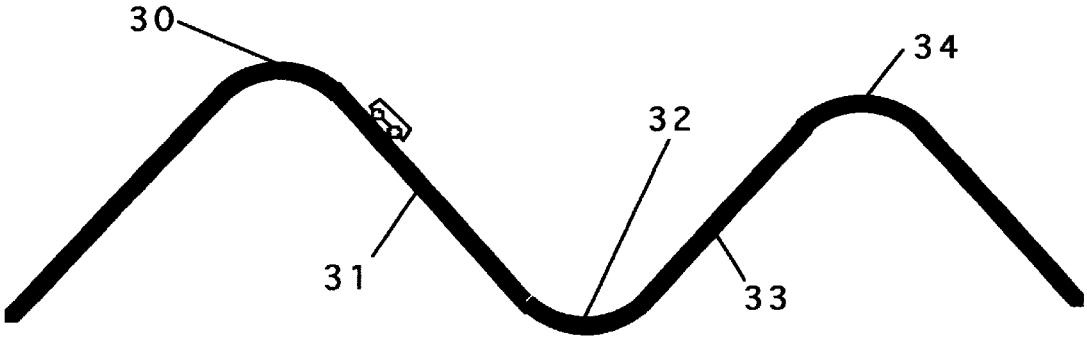
FIG. 8 is a side view of a portion of a track illustrating a typical environment in which the vehicle of the subject invention would operate.

FIG. 8 is a side view of a portion of a typical roller coaster track. As the vehicle 1 moves down the descending portion 31 of the track from the first peak 30 most of its potential energy is transferred to the rotational kinetic energy of flywheel 6 rather than the translational kinetic energy of vehicle 1. This results in reduced translational velocity of vehicle 1. After vehicle 1 passes valley 32 the rotational kinetic energy of flywheel 6 is then released to propel vehicle 1 back up the ascending portion 33 of the track to the second peak 34, at which point the vehicle has the same total potential plus kinetic energy it would have if there were no flywheel. The initial potential energy of vehicle 1 is mostly conserved over the course of the track, except for frictional energy loss, just as with a real roller coaster. But at all points on the track the velocity of vehicle 1 is reduced by a constant factor compared to an unrestrained free-fall vehicle. Thus the dynamic speed profile of the toy vehicle 1 is the same as for an unrestrained gravity-powered vehicle throughout its descending and ascending journey, but at a proportionately reduced speed.

If friction or drag were instead used to slow the vehicle it would dissipate most of the original potential energy, the velocity profile would be changed, and the vehicle would stop well short of the top of the next hill. Similarly a toy vehicle that is motor-driven could be made to run slower, but the velocity profile would be much different than for a free-fall vehicle.

If the mass of flywheel 6 is large with respect to the mass of the remainder of vehicle 1, then the reduction in translational velocity of vehicle 1 depends primarily on both the ratio of the angular velocity of flywheel 6 to the angular velocity of wheels 3, and the ratio of the diameter of flywheel 6 to the diameter of wheel 3. The higher the multiplying ratio of output to input of the gear train 7, and the higher the ratio of the diameter of flywheel 6 to the diameter of wheel 3, the greater will be the velocity reduction effect caused by energy stored in the flywheel.

With both real roller coasters and previous embodiments of model roller coasters there is minimal need for traction between the vehicle wheels and track since the vehicle is in a normal free-fall condition. However, with the embodiment of the present invention traction between wheels 3 and rails 4 is needed to supply the force needed to turn flywheel 6 without the wheels 3 slipping. On a slightly inclined track the gravitational force of the wheel against the track is sufficient to provide the necessary traction. However, at the steep angles of typical roller coaster tracks, the component of gravitational force perpendicular to the track may not result in sufficient traction.

An embodiment of the present invention uses magnetic attraction between toy vehicle 1 and rails 4 with either permanent magnets 26 in the chassis 5, or with wheels 3 made of permanent magnetic material, and with ferromagnetic material in the rails 4. The force of magnetic attraction increases the instantaneous static friction between the rolling wheels 3 and rails 4 at their point of contact in order to provide increased traction, but since there is no sliding friction there is minimal energy loss. The resultant magnetic force is perpendicular to rails 4 and so causes neither a pushing nor a dragging force on the vehicle 1.

If the wheels 3 are of permanent magnetic material a thin coating of more pliable material may be used on the wheel circumference to increase traction, and the flanges 11 on the wheels can be made of non-magnetic material to preclude unwanted lateral magnetic attraction to the rails 4.

If necessary for very steep angles of the track the free rotating wheels 3*a* may also be made of permanent magnet material. This would also be desirable for track configurations, such as a loop-the-loop, where the vehicle 1 is momentarily in a partially or totally inverted position.

Figure 4:
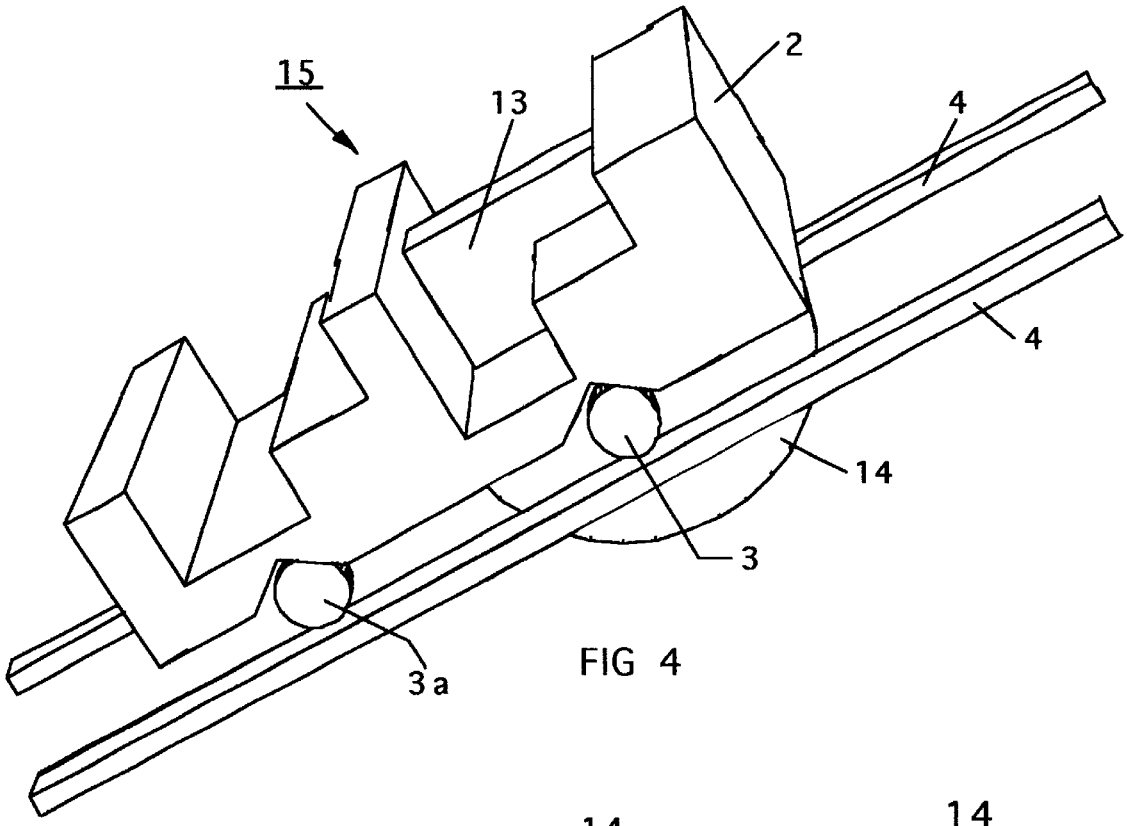
FIG. 4 is a perspective view of a toy roller coaster vehicle according to the second embodiment of the present invention where the flywheel and wheels are mounted on a common shaft.
Figure 5:
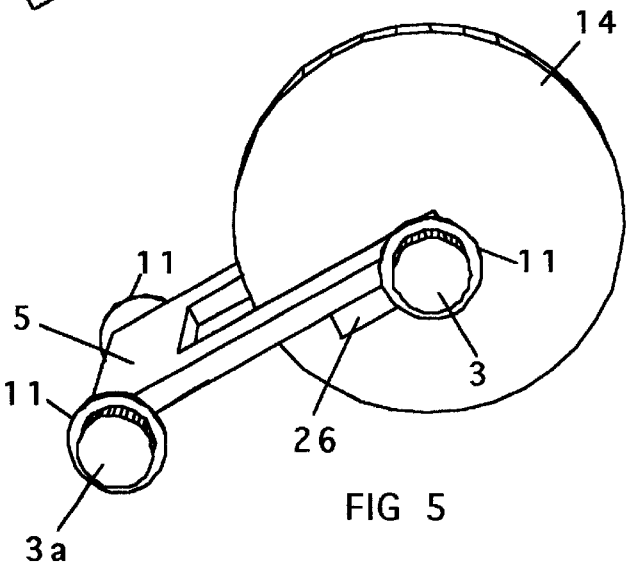
FIG. 5 is a perspective view of the chassis, wheels, and flywheel of the vehicle of FIG. 4 with the outer body removed.

There is shown in FIGS. 4 and 5 a second embodiment of a toy roller coaster. FIG. 4 shows a vehicle 15 with a light-weight body-shaped cover 2 in place and resting on a section of track rails 4. FIG. 5 shows the vehicle 15 without the cover 2 and rails 4. This second embodiment operates in a manner similar to the first embodiment except that a flywheel 14 is coupled to a pair of driving wheels 3 by direct connection to the same axle as wheels 3. Flywheel 14 therefore rotates with the same angular velocity as wheels 3. An advantage of this embodiment is that both the cost of gear train 7 of the first embodiment, and the energy loss due to friction normally found in such devices, is eliminated.

Figure 13:
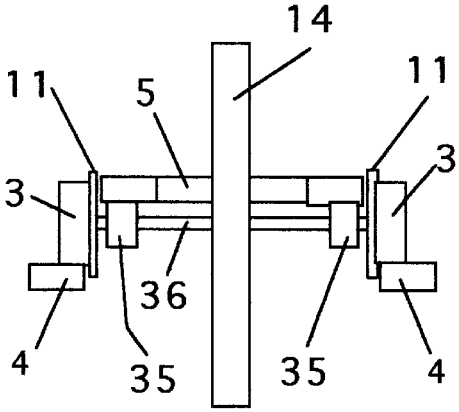
FIG. 13 is a forward-facing rear view of the vehicle in FIG. 5.

FIG. 13 is a forward-facing rear view of the vehicle of FIG. 5. Bearing 35 is a low friction bearing of the roller bearing, ball bearing, or solid journal box bearing type which rotationally connects axle 36 to the chassis 5 with freedom to rotate.

If the mass of the flywheel 14 in the second embodiment is large with respect to the mass of the remainder of the vehicle 15, then the reduction in translational velocity of the vehicle 15 depends primarily on the ratio of the diameter-of flywheel 14 to the diameter of the driving wheels 3. The velocity reduction does not depend upon the ratio of angular velocities as in the first embodiment, because the ratio is fixed at one-to-one in the second embodiment. Because flywheel 14 only rotates at the same angular velocity as wheels 3 it must be larger in diameter than in the first embodiment in order to achieve sufficient rotational kinetic energy. The higher the ratio of flywheel 14 diameter to wheel 3 diameter, the greater will be the velocity reduction effect caused by energy stored in the flywheel 14.

Body-shaped cover 2 incorporates a flywheel cover 13. Flywheel 14 can have a dark surface finish such that the portion extending below the body-shaped cover 2 will tend to visually disappear in the illusion of the model.

In this second embodiment shown in FIG. 4, wheels 3 or magnet 26 are made of permanent magnetic material, and rails 4 are made using ferromagnetic material in the same way as in the first embodiment shown in FIG. 1.

Figure 6:
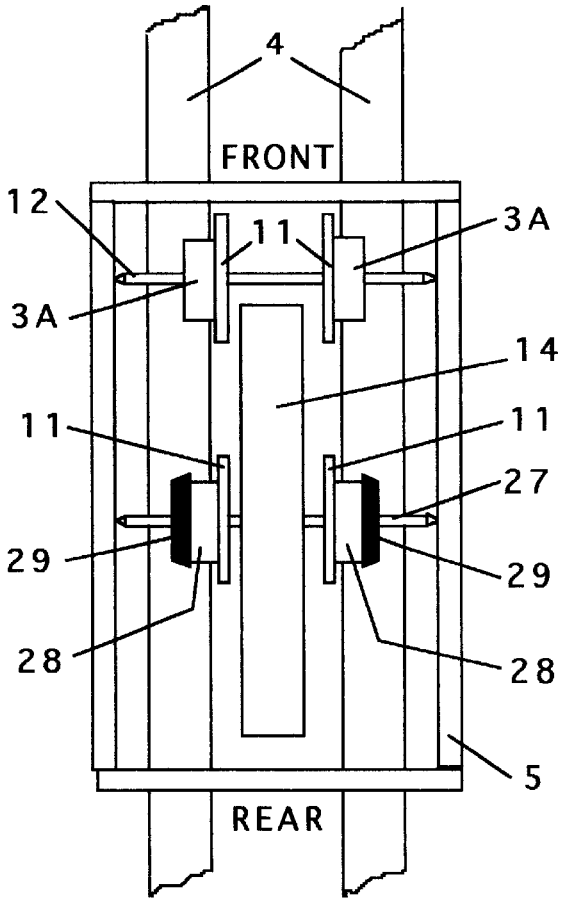
FIG. 6 is a top view of a variant of the vehicle of FIG. 5 in which the chassis is external to the wheels.
Figure 7:
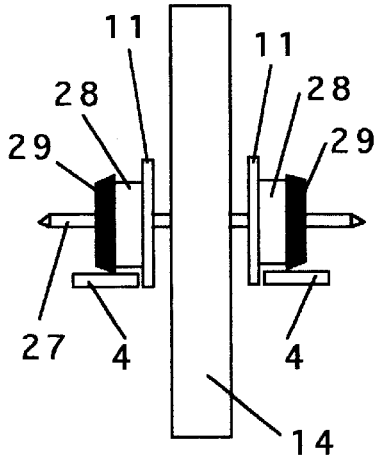
FIG. 7 is a forward-facing rear view of the rear wheels, axle, and flywheel of the vehicle of FIG. 6.

FIG. 6 is a top view of a variant of the vehicle of FIG. 5 in which the chassis 5 is external to the wheels 3A and 28. Axles 12 and 27 are connected to chassis 5 with low-cost needle bearings comprised of conical shaped ends on axles 12 and 27 mating with conical shaped depressions in chassis 5. Disks 29 of ferromagnetic material are attached to permanent magnet wheels 28, and as shown in the forward-facing rear view of FIG. 7 serve to direct magnetic flux to tracks 4 also of ferromagnetic material. The diameter of disks 29 is slightly larger than the diameter of magnetic wheels 28 wherein contact with track 4 is by disks 29. The periphery of disks 29 is tapered slightly as shown wherein their contact with track 4 is approaches a point contact for reduced frictional energy loss.

There are several considerations in the design of the toy vehicle. The FIRST CONSIDERATION is that for motion realism the toy vehicle should have a velocity profile that is approximately proportional to the velocity profile of a full-scale, gravity-powered vehicle (i.e. the toy vehicle velocity at all scaled points on its track being an approximately constant fraction of the velocity of the full-scale gravity-powered vehicle at the corresponding points on its track). For this to happen the toy vehicle must obtain all of its kinetic energy increase from the loss of its potential energy as it moves down a descending inclined plane, and must release its kinetic energy back to a gain of potential energy as it moves back up an ascending inclined plane. That is, there should be no external injection of energy if the vehicle is to have a velocity profile proportional to that of a true gravity-powered vehicle. Likewise, there must also be minimal net loss of total energy (potential plus kinetic)—just as with a real roller coaster.

A practical criteria for the amount of energy loss is that vehicle energy conservation should such that the gain in kinetic energy of the vehicle is at least 80% of its loss of gravitational Latential energy when rolling down a plane inclined five degrees to the horizontal. One way to measure this is to allow the vehicle to roll down a surface similar to FIG. 12 (except slopes are only five degrees) consisting of a descending surface 31, followed by a valley 32, followed by an ascending surface 33. If the vehicle is allowed to roll from a static start on the descending surface 31 to a static stop on the ascending surface 33, the height at the point (Lof static stop above the level of the valley 32 should be at least 60% of the height of the static start above the level of the valley 32 (i.e. a 20% total energy loss on the descending surface followed by an additional total energy loss of approximately 20% on the ascending surface).

It would be possible to control the velocity of a toy vehicle to provide a realistic velocity profile by a controlled breaking action on a descending plane, and a controlled injection of power on an ascending plane, but it would require a complex and more expensive mechanism to control these forces in accordance with the slope of the inclined planes in such a way that a realistic velocity profile is maintained.

A SECOND CONSIDERATION is the Velocity Reduction Factor.

The Velocity Reduction Factor is defined as a divisor by which the toy vehicle velocity is reduced wherein the velocity is an approximately constant fraction, at all points on a track, of the velocity of an unrestrained toy vehicle containing no flywheel.

The Velocity Reduction Factor should be at least 2 if the toy vehicle is to fit reasonably in the home environment. This requirement is because for exact realism the velocity should be reduced by the square root of the model scale factor. Exact realism is defined as a velocity that at every point on the descending and ascending planes is reduced in proportion to the scale of the model compared to the velocity of a model rolling in unrestrained free-fall motion. A model roller coaster at a scale of 25 to 1 (requiring a Velocity Reduction Factor of 5 for exact realism) is about the largest that would fit practically in the home environment. A smaller model scale of 49 to 1 or even 81 to 1 would be better. While exact realism is not a requirement for a toy, and a necessary degree of realism cannot be exactly specified, a Velocity Reduction Factor of at least 2 is a reasonable requirement depending on the model scale. This places certain requirements on the configuration of the flywheel which will be described later as a FOURTH CONSIDERATION.

A THIRD CONSIDERATION is that the mass of the vehicle including wheels, axles, chassis, body (but excluding the flywheel mass) should be small compared to the mass of the flywheel, because the vehicle mass subtracts from the velocity reduction provided by the flywheel. For example, a vehicle mass of one-half the flywheel mass results in a Velocity Reduction Factor 18% less than would occur with a vehicle of zero mass. And a vehicle mass equal to the flywheel mass results in a Velocity Reduction Factor 28% less than would occur with a vehicle of zero mass. At the same time, it is desirable to keep the total mass of the flywheel plus the vehicle small while still maintaining an appropriate ratio between those two masses, because increasing the total mass of the vehicle plus its flywheel increases the wheel traction necessary to prevent the wheel from sliding on an inclined plane rather than rolling.

Figure 12:
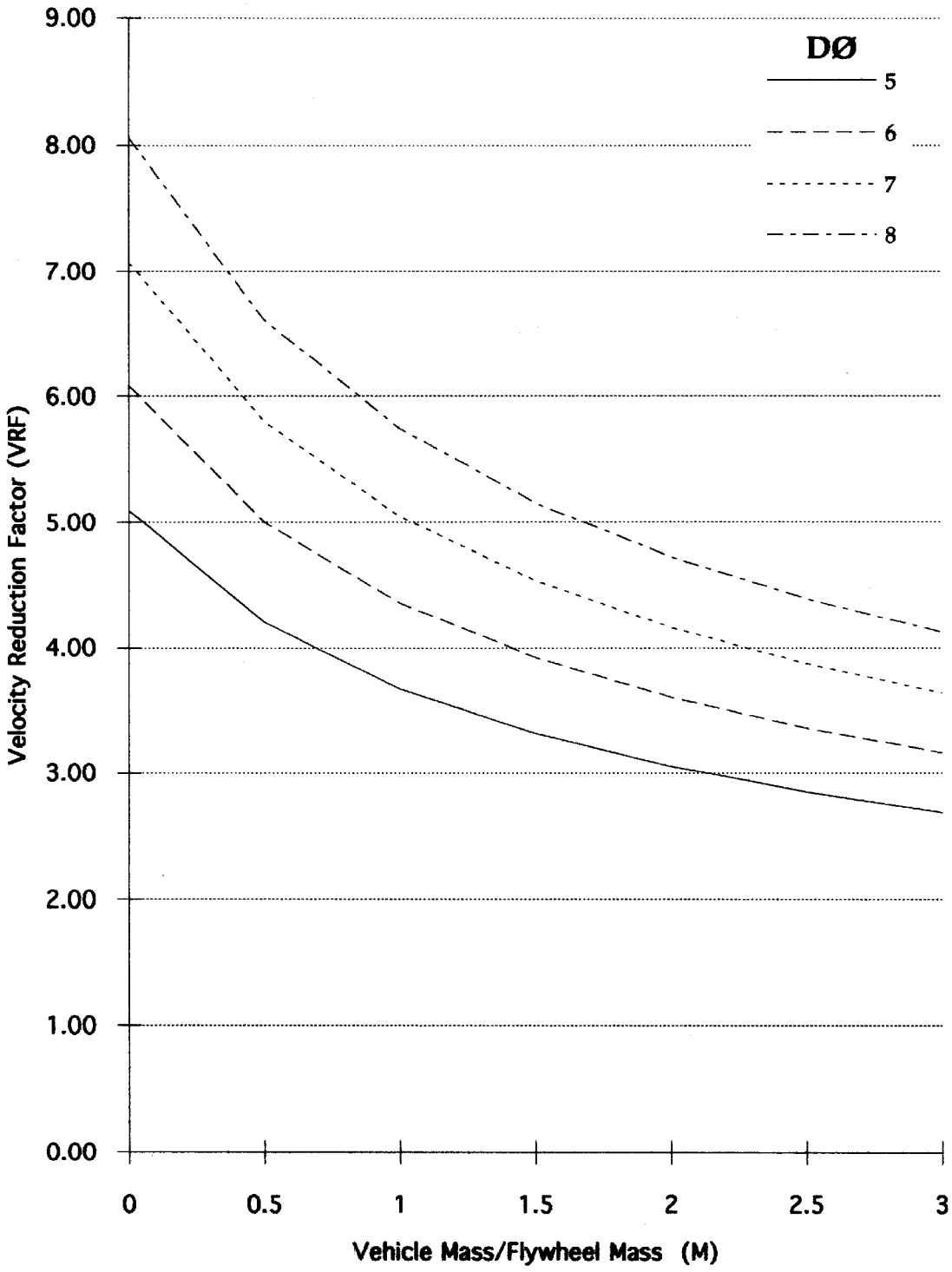
FIG. 12 is a graph showing the effect of changes in the flywheel configuration, and changes in the ratio of vehicle mass to flywheel mass, on a Velocity Reduction Factor.

FIG. 12 is a graph showing the change in the Velocity Reduction Factor (VRF) with change in the ratio of vehicle mass (excluding the flywheel mass) to flywheel mass for various values of flywheel diameter and rotational velocity.

The VRF is given by the equation:

$$VRF=\sqrt{(M+(1+D^{2Ø^2}))\div(M+1)}$$

where: VRF=Velocity Reduction Factor

M=ratio of vehicle mass divided by flywheel mass

D=ratio of flywheel diameter divided by the driving wheel diameter

Ø=ratio of flywheel rotational velocity divided by the driving wheel rotational velocity This formula assumes all of the flywheel mass in concentrated on its periphery.

It can be seen in FIG. 12 that when the vehicle mass is very low the Velocity Reduction Factor is approximately equal to DØ, the product of the flywheel diameter ratio times the rotational velocity ratio, and decreases as the ratio of vehicle mass to flywheel mass increases.

A FOURTH CONSIDERATION is the relationship between the wheel of the toy vehicle and the flywheel which is rotationally coupled to the wheel. If the flywheel has the same radius and the same rotational velocity as the vehicle wheel it has little effect on the velocity of the vehicle, regardless of the flywheel mass. It can be shown that a disk (flywheel) of homogeneous mass rolls down an inclined plane at a velocity that is reduced by a factor of only 1.22 compared to the velocity of a frictionless mass sliding down the same plane—independent of the mass or diameter of the flywheel. This is because the tangential velocity of the periphery of a rolling wheel (which is proportional to the wheel's rotational velocity) is always equal to the translational velocity of the wheel mass. It is simply a matter of the physical laws of dynamic motion of a rigid body under the force of gravity, and is similar to the fact that all bodies fall at the same velocity independent of their mass. If the flywheel instead has all of its mass concentrated at its periphery the Velocity Reduction Factor is greater, but is still only 1.41. For example, a frictionless sled slides down a snow covered hill at less than 1.4 times the velocity of a rimless car tire (or even a huge tractor tire for that matter) on the same hill. Thus it can be seen that when considering the mass of the total vehicle, the velocity reduction of a vehicle due to the slight flywheel effect of its wheels is quite minor.

In order for the toy vehicle to be slowed by a factor of 2 or more, the rotational kinetic energy of the flywheel must be large compared to the translational kinetic energy of the vehicle. Because the rotational kinetic energy of a flywheel is proportional to the square of its radius and the square of its rotational velocity, one and/or the other must be increased beyond that of a rolling wheel to provide the desired Velocity Reduction Factor. It can be seen by the equation in the THIRD CONSIDERATION above that if the mass of the vehicle is negligible compared to the mass of the flywheel, the Velocity Reduction Factor is approximately equal to the product of the ratio of the flywheel diameter to the wheel diameter times the ratio of the flywheel rotational velocity to the wheel rotational velocity. If, for example, the flywheel is mounted on the same axle as the vehicle wheel, wherein its rotational velocity is the same as the wheel's , then the Velocity Reduction Factor is approximately equal to the ratio of the flywheel diameter to the wheel diameter. Conversely, if the diameter of the flywheel is the same as the diameter of the wheel, the Velocity Reduction Factor is then approximately equal the ratio of the flywheel rotational velocity to wheel rotational velocity (e.g. approximately equal to the gear ratio of a gear train between the wheel axle and the flywheel).

A FIFTH CONSIDERATION is the need to provide sufficient traction force between the toy vehicle wheel and the inclined plane wherein the wheel is able to turn the flywheel without slipping. At low slopes the gravitational force of the vehicle normal to the inclined plane provides sufficient traction to prevent the wheel from slipping. But as the slope increases the component of gravitational force that is normal to the inclined plane is reduced resulting in lower static friction (fraction) of the rolling wheel on the inclined plane. At the same time the component of gravitational force pushing on the vehicle is increased. Both actions increase the tendency of the wheel to slide rather than roll. If the wheel begins to slide energy is dissipated by sliding friction, and the vehicle velocity immediately increases due to the lower force opposing the vehicle motion since the force of sliding friction is lower than that of the static friction of a rolling wheel.

A SIXTH CONSIDERATION, is related to the fifth in the need to avoid energy loss due to sliding friction. If two wheels are both mounted on a common axle, differential wheel travel would occur at such times as when the vehicle follows a curved path. This would result in a critical loss of energy because one of the wheels would necessarily slide rather than roll. One way to minimize the energy loss is to minimize the sliding friction on one of the wheels by using a low friction, non-ferromagnetic material such as plastic on that portion of the inclined plane under that one wheel. This can be done when the slope of the plane is low enough that traction under the other wheel is sufficient to keep it in a rolling, static friction state.

Another way to prevent sliding friction is to avoid having two wheels on a common axle. This can be done by having each wheel drive a separate flywheel with each flywheel being of one-half the mass. While both methods are included in the claims the first method would likely provide a lower cost solution.

Figure 9:
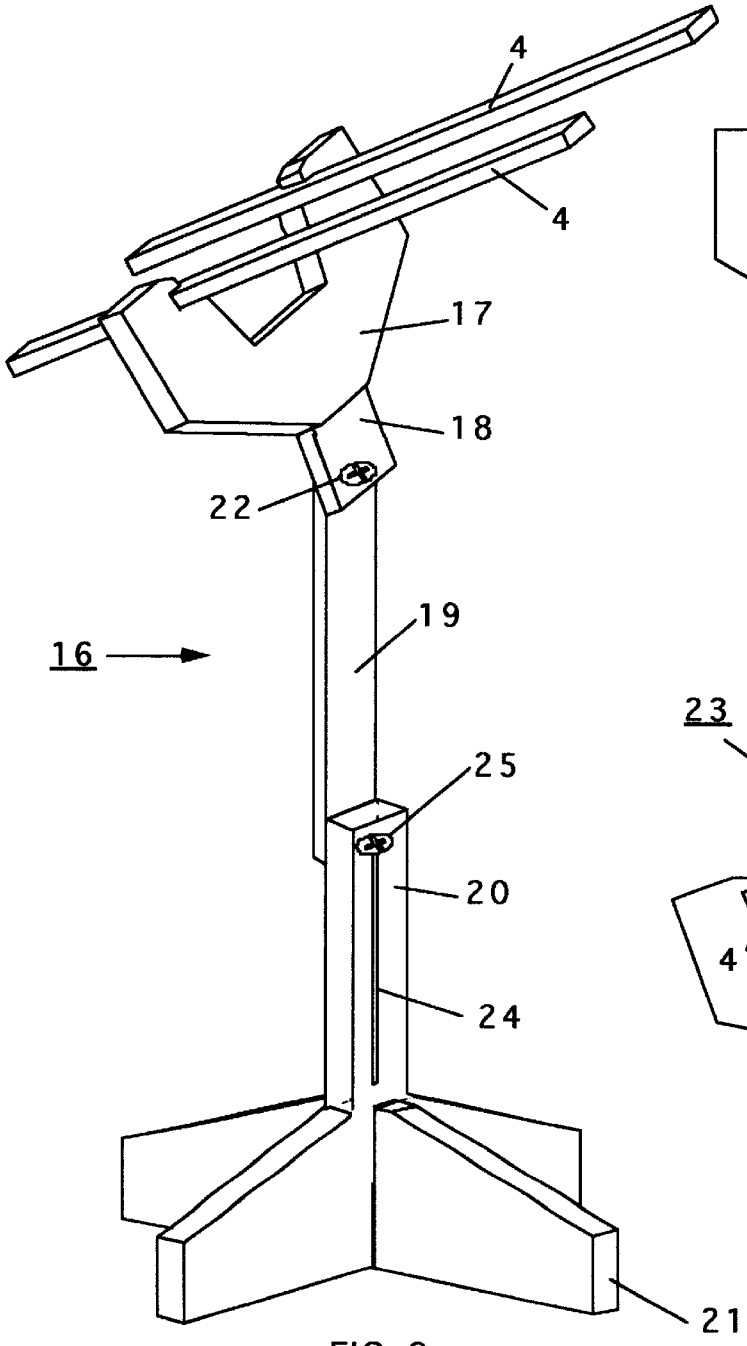
FIG. 9 is a perspective view of the rails and vertical stanchion that provides a track compatible with the vehicle of FIG. 4.
Figure 10:
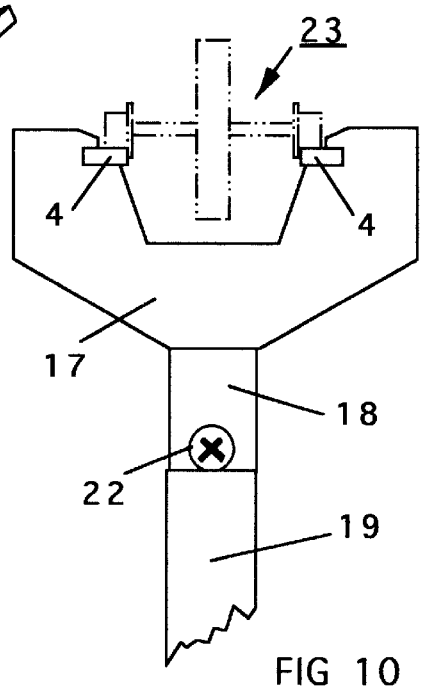
FIG. 10 is a front view of a portion of the track of FIG. 9 with the wheels, axle, and flywheel of FIG. 5 shown in phantom view.
Figure 11:
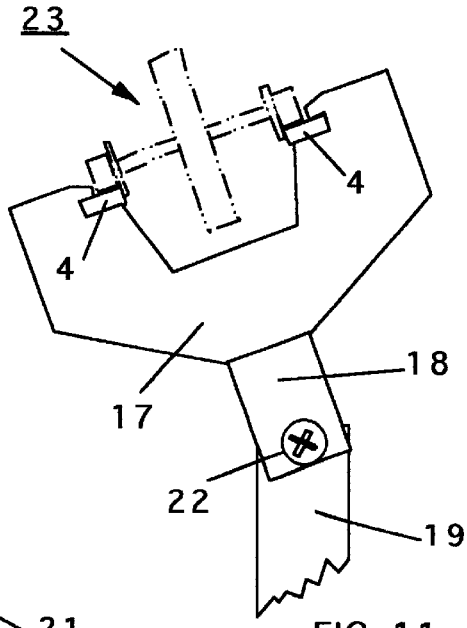
FIG. 11 is the same view as FIG. 10 but with the cross member rotated to hold the rails at a banked angle.

There is shown in FIGS. 9–11 a vertical stanchion 16 for a toy roller coaster track assembly compatible with the vehicle of FIG. 4. A cross member 17 supports a pair of rails 4. Cross member 17 is made to provide clearance for the flywheel of vehicle 15 in FIG. 4 which is shown along with the wheels and axle of the vehicle as item 23 in phantom view in FIG. 10. A support member 18 is made of non-recovering bendable material which allows cross member 17 to be positioned to the desired slope angle of the rails. Support member 18 is attached to a vertical support member 19 with a screw 22 to allow cross member 17 to be positioned to the desired bank angle of the rails. A vertical support member 20 has a slot 24 which allows track height adjustment by screw 25 attachment to support member 19. Vertical support member 20 and a base support piece 21 have interlocking slots that fit together to form a base supporting structure.

Multiple vertical support members 19 can be used to extend the vertical stanchion to greater heights. Multiple vertical stanchions and rail sections can be used to provide an endless variety of track structures.

The present invention is not limited to the above described embodiments, and various modifications and applications are possible. It will be appreciated by those skilled in the art that changes could be made to the embodiments described above without departing from the broad inventive concepts thereof. It is understood, therefore, that the present invention is not limited to the particular embodiments disclosed, but is intended to cover modifications within the spirit and scope of the present invention as defined by the appended claims.

For example, the embodiments of the present invention employs a two-rail track structure for supporting a vehicle having four wheels. Monorail and multiple rail structures are also possible within the system of the invention. Furthermore, the embodiments shown use flywheel energy storage driven by the rear wheels of the vehicles. However, the flywheel may alternatively be driven by the front wheels, or there may be multiple flywheels driven by multiple wheels. A monorail configuration might use two flywheels—one on each side of the monorail. If the track configuration and material allow sufficient traction to be maintained without the force of magnetic attraction the use of permanent magnets can be eliminated within the scope of the present invention. And, of course, the model body itself can be made much more physically realistic than that shown in these drawings.

Thus the reader will see that the energy-storing principle of the present invention will provide an important element of realism in gravity-powered toy vehicles—the element of dynamic motion realism.

Request Under MPEP §707.07(j)

The applicant is a pro se applicant submitting his first CIP following his first patent application. He respectfully requests that if the Examiner finds patentable subject matter disclosed in this application, but feels the present claims are not entirely suitable or could be made stronger, the Examiner draft one or more allowable claims for the applicant.

What is claimed is:

1. A gravity-powered miniature toy vehicle, of a model roller coaster type comprising:

a supporting chassis, at least one axle rotationally connected to said chassis with freedom to rotate, at least one wheel with at least one flywheel rotationally coupled to said wheel, wherein said flywheel is coupled to said wheel by direct connection to the same said axle as said wheel, wherein rotation of said wheel causes rotation of said flywheel when said wheel rolls on a track on which said vehicle is intended to roll, wherein a ratio of a diameter of said flywheel to a diameter of said wheel is at least 2, and wherein said toy vehicle is propelled substantially by a force of gravity alone from a point of elevation wherein changes in a kinetic energy of said vehicle result only from changes in gravitational potential energy of said vehicle and frictional energy loss.

2. The miniature vehicle of claim 1 further comprising:

a permanent attached to said chassis; wherein a magnetic attraction force exists between said chassis and said track on which said vehicle is intended to roll when said truck induces ferromagnetic material.

3. The miniature vehicle of claim 1 further comprising:

a permanent magnet included as an integral part of said wheel wherein a magnetic attraction force exists between said wheel and said track on which said vehicle is intended to roll when said track includes ferromagnetic material.

4. A gravity-powered miniature toy vehicle, of a model roller coaster type comprising:

a toy vehicle configured to roll on an intended track including descending and ascending inclined surfaces, wherein said toy vehicle includes no significant internal or external power source, wherein said toy vehicle is propelled substantially by force of gravity alone after being raised to a point of elevation; and a means for storing a portion of a gravitational potential energy of said toy vehicle derived from a change in elevation of said toy vehicle when said toy vehicle rolls down said descending surfaces of said intended track, wherein a gain in translational kinetic energy inherent in the velocity of said toy vehicle is reduced by said portion of said gravitational potential energy stored in said energy storing means, wherein at all points on said descending surfaces the velocity of said toy vehicle is reduced by a factor of at least 2 compared to said toy vehicle have no said energy storing means; and a said means for storing the gravitational potential energy also comprising means for returning said energy stored in said energy storing means back to gravitational potential energy of said toy vehicle to help propel said toy vehicle up said ascending surfaces of said intended track.

5. The gravity-powered miniature toy vehicle of claim 4 further comprising:

a means for increasing traction of said vehicle on said intended track, wherein loss of total potential plus kinetic energy of said vehicle is minimized as said vehicle rolls on said intended track.

* * * * *

UNITED STATES PATENT AND TRADEMARK OFFICE

CERTIFICATE OF CORRECTION

PATENT NO. : 6,482,070 B2 
DATED : November 19, 2002
INVENTOR(S) : Philip A. Hogan It is certified that error appears in the above-identified patent and that said Letters Patent is hereby corrected as shown below:

Column 6,
Line 45, "should such" should read -- should be such --;
Line 47, "Latential" should read -- potential --; and
Line 54, "point (Lof" should read -- point of --.

Column 7,
Line 49,

"$VRF=\sqrt{(M+(1+D^{2}\varnothing^{2}))\div(M+1)}$" should read

-- $VRF=\sqrt{(M+(1+D^{2}\varnothing^{2}))\div(M+1)}$ --; and

Line 57, "mass in" should read -- mass is --.

Column 8,
Line 55, "fraction)" should read -- (traction) --.

Column 10,
Line 24, "permanent attached" should read -- permanent magnet attached --; and
Line 27, "truck induces" should read -- track includes --.

Signed and Sealed this

Fifteenth Day of April, 2003

JAMES E. ROGAN
*Director of the United States Patent and Trademark Office*